US006230910B1

(12) United States Patent
Olsson et al.

(10) Patent No.: US 6,230,910 B1
(45) Date of Patent: May 15, 2001

(54) SELF-LOCKING BEAM CLIP

(75) Inventors: John M. Olsson, Tampa, FL (US); James B. McDermott, Canton, GA (US)

(73) Assignee: Auto-Lok, Inc., Acworth, GA (US)

( * ) Notice: Subject to any disclaimer, the term of this patent is extended or adjusted under 35 U.S.C. 154(b) by 0 days.

(21) Appl. No.: 09/281,340

(22) Filed: Mar. 30, 1999

Related U.S. Application Data

(63) Continuation-in-part of application No. 09/052,486, filed on Mar. 31, 1998, now abandoned.

(51) Int. Cl.[7] ..... A47F 5/00

(52) U.S. Cl. ..... 211/192; 248/222.11; 248/221.11

(58) Field of Search ..... 211/192, 189; 403/254, 353, 316; 248/243, 222.13, 222.14

(56) References Cited

U.S. PATENT DOCUMENTS

| | | | | |
|---|---|---|---|---|
| 3,055,462 | | 9/1962 | Steele . | |
| 3,273,720 | | 9/1966 | Seiz . | |
| 3,303,937 | | 2/1967 | McConnell . | |
| 3,346,126 | | 10/1967 | Bloom et al. . | |
| 3,351,212 | | 11/1967 | McConnell . | |
| 3,392,848 | | 7/1968 | McConnell et al. . | |
| 3,422,962 | | 1/1969 | Burns et al. . | |
| 3,456,970 | | 7/1969 | Sunasky . | |
| 3,545,626 | * | 12/1970 | Seiz | 211/176 |
| 3,592,345 | | 7/1971 | Featherman . | |
| 3,612,290 | | 10/1971 | Evans . | |
| 3,626,487 | | 12/1971 | Seiz . | |
| 3,702,137 | | 11/1972 | Evans . | |
| 3,814,491 | * | 6/1974 | Kackley | 403/353 X |
| 3,881,829 | * | 5/1975 | James | 403/254 X |
| 3,986,318 | | 10/1976 | McConnell . | |
| 4,165,944 | | 8/1979 | Sunasky . | |
| 4,236,642 | | 12/1980 | Klein . | |
| 4,287,994 | | 9/1981 | Klein . | |
| 4,448,315 | | 5/1984 | Obermeyer . | |
| 4,470,716 | * | 9/1984 | Welch | 403/254 |
| 4,496,061 | | 1/1985 | Highsmith . | |
| 4,558,838 | | 12/1985 | Klein . | |
| 4,618,064 | | 10/1986 | Viklund . | |
| 4,632,222 | * | 12/1986 | Chen | 182/179 |
| 4,904,110 | | 2/1990 | Klein . | |
| 4,909,402 | | 3/1990 | Highsmith . | |

(List continued on next page.)

*Primary Examiner*—Daniel P. Stodola
*Assistant Examiner*—Khoa Tran
(74) *Attorney, Agent, or Firm*—Buchanan Ingersoll P.C.

(57) ABSTRACT

A self-locking beam clip for attaching an end of a beam to a column can having a vertical array of apertures with wide upper regions and narrow lower regions. The beam clip can be angle shaped having a front flange with one or more fixed connecting pins mounted thereon. Each fixed pin can have a shank sized to pass through both the upper and lower regions and an inner head sized to pass only through the upper region. A latch is provided which can be a bent member, having a flat lower portion connected to the front flange and an upper portion extending at an angle to the lower portion and away from the front flange. The lower portion can be configured to pivot about the front flange where it is connected. The lower portion also has a locking portion which projects through a hole in the front flange. In a locked position, when the beam clip is connected to a column, the locking portion automatically projects through an aperture common with one of the fixed pins. The fixed pin occupies the lower region of the aperture and the locking portion occupies the upper region. The locking portion abuts the top of the upper region thus preventing the beam from being moved relative to the column. The locking portion can be moved to an unlocked position by pushing on the upper portion, which causes the latch to pivot about the front flange, thus retracting the locking portion from the aperture.

14 Claims, 8 Drawing Sheets

U.S. PATENT DOCUMENTS

| | | | | |
|---|---|---|---|---|
| 4,955,743 | | 9/1990 | King . | |
| 5,025,937 | | 6/1991 | King . | |
| 5,131,781 | | 7/1992 | Klein . | |
| 5,350,074 | | 9/1994 | Rosenband . | |
| 5,492,231 | | 2/1996 | Clark . | |
| 5,526,945 | | 6/1996 | Clark et al. . | |
| 5,624,045 | | 4/1997 | Highsmith et al. . | |
| 5,653,349 | * | 8/1997 | Dana et al. | 211/189 |
| 5,713,476 | | 2/1998 | Highsmith et al. . | |
| 5,749,481 | | 5/1998 | Miller . | |
| 5,791,502 | * | 8/1998 | Bietz et al. | 211/192 |
| 5,938,367 | * | 8/1999 | Olson | 403/254 |

* cited by examiner

SELF-LOCKING BEAM CLIP

REFERENCE TO RELATED APPLICATION

This application is a continuation-in-part of U.S. patent application Ser. No. 09/052,486, filed Mar. 31, 1998, now abandoned. The entirety of that application is hereby incorporated herein by reference.

BACKGROUND

This invention relates generally to a beam clip used to secure load bearing beams to columns of upright frames in industrial storage rack systems, and, more particularly, to a beam clip having a self-locking feature to prevent the beams from becoming unintentionally disengaged from the columns.

Industrial type storage racks are typically constructed of interconnected beams and columns. In the usual case, the beam is connected to the columns of an upright frame via a connector that is welded or otherwise rigidly attached at each end of the beam. Typically, this connector is an angle shaped bent plate, often referred to as a clip, having a side flange welded to the end of the beam and a front flange which is provided with projections which attach the beam to the front face of the columns of the upright frame. The clip can be fitted against the column with the side flange adjacent the side wall of the column and the front flange against the front face of the column. In the usual case, the front face of the column has a linear array of regularly spaced apertures. The projections on the front flange of the clip can be configured to be inserted through and retained in the apertures in the front face of the column to hold the end of the beam thereagainst. Many of these devices attach to the side flange of the connector and engage into apertures in the side walls of the column.

Preferably, a locking device should be provided to restrain the front flange from becoming dislodged unintentionally from the front face of the column. Numerous locking devices have been disclosed for retaining the beam against the column for preventing unintentionally disengagement.

One such device employs a spring member latch mounted on the front flange of the clip. Such a spring member latch is illustrated in U.S. Pat. No. 5,624,045 to Hysmith et al., in FIGS. 12–13 labeled "Prior Art." The spring member has a flat portion which lies adjacent the front flange with one end attached to a first connector, which is typically a rivet, mounted on the front flange and an opposite end which extends towards a second rivet mounted on the flange. The rivets typically have a shank portion and an inner head portion larger than the shank. The opposite end has a latch portion projecting generally perpendicular to the flat body. The latch portion projects through a hole provided in the front flange near to the second connector. The latch is also long enough to project through one of the apertures when the clip is connected to the column. When the clip is installed on the column, each rivet projects through separate apertures in an upper region of each aperture. To lock the clip in place, the beam, and the clip, is moved downwards causing the rivets to then slide down into a narrow lower region of the apertures where the inner heads of the rivets are larger to be removed. When the rivets slide down into the narrow lower region the apertures the latch portion can then project through the upper region of an aperture common with one of the rivets. Thus, the locking portion prevents the beam from being lifted upwardly so long as it projects through the upper region of the aperture. To remove the clip, the locking portion must first be removed from the upper region of the aperture by flexing the flat body of the spring member. When the locking portion is thus removed, the clip can be moved upwards to permit the rivets to be removed back through the upper region of the apertures.

There can, however, be some disadvantages associated with such a spring member latch. For example, the spring member can be difficult to grasp and flex outward to dislocate the locking portion from the aperture when the beam is desired to be removed from the column. Additionally, for example, if the spring member is excessively flexed the spring can be bent or broken.

Another type of locking device, which is the subject of the Hysmith patent, is where the flanged clip has a central latching pin mounted to the front flange which is slideable along a vertical slot provided therein. The latching pin has an inner head, like the fixed connecting pins, or rivets, mounted on the front flange, which is configured to take advantage of the apertures in the columns that conventionally have a wide upper region and narrow lower region. The inner head is sufficiently small to be insertable in the wide upper portion of the aperture, but larger than the lower region thereof so that once installed the pin cannot be removed from the aperture. The latching pin is freely slideable along the vertical slot such that an upward movement of the beam would not result in an upper movement of the latching pin. If the beam were lifted upwardly such that the connecting pins might be dislodged from the apertures, the latching pin would nonetheless remain in the narrow portion of the aperture so that the beam could not be unintentionally dislodged from the column.

However, there can also be some disadvantages to using this kind of locking device. For example, since the latching member floats in the slot it cannot bear any weight. Thus, the amount of weight the beam can support is reduced by one third. Also, the weight of the floating pin actuates the latching function. But, since the weight of the pin itself is not significant, even a small amount of friction between the pin and the slot could cause the pin to stick and not fully drop down into a latched position. Consequently, even a small amount of rust, dirt, grease, etc. in the flange slot could conceivably prevent the pin from fully latching. Also, since these storage racks may remain assembled in warehouses for long periods of time, the latching pin can also become stuck in the vertical slot making it difficult to disconnect the beams from the columns. For example, the same rust, dirt, grease, etc. could accumulate between the latching pin and the flange slot which could cause the latching pin to stick in the latched position. Additionally, the accessible end of the latching pin is small and is not configured to be easily grasped. Thus, it could be difficult to manually move the latch or break it free if it were to become stuck.

Other types of self locking latches are known in the art which utilize spring biased locking mechanisms to retain the locking portion in a latched position. Most of these require a screw driver or other similar tool to manually flex the spring member to unlatch the beam clip. Others are designed to be grasped and pulled by hand. However, beam clips such as those described above, and herein, are about the size of a persons hand. The latches are a relatively small component and can be difficult to grasp even with bare hands. The situation is complicated even more when gloves are worn, as is common in the environment, typically warehouses and storage rooms, where storage racks such as described herein are frequently employed.

Thus, there is a need for a self-locking beam clip for preventing the beams from becoming unintentionally disengaged from the columns which is also designed to be quickly, easily and positively latched and unlatched. Such a beam clip preferably has a positive, self-locking engagement, and can be easily unlatched simply by pushing on the latch instead of having to pull on some small portion of the latch. The self locking latch also should not detract from the weight bearing capabilities of the beams and should be aesthetically appealing. The latch can also be configured to prevent damaged by over extension if unlatched in an improper manner.

SUMMARY

In accordance with the present invention there is provided a self-locking beam clip for mounting the end of a beam to the front face of a column of a storage rack constructed of multiple interconnected horizontal beams and vertical columns. The columns conventionally are provided with an array of similar, spaced apertures on a front face. The apertures typically have a wide upper region and a narrow lower region. The beam clip preferably has a self-locking latch member so that the clip automatically locks onto the column to prevent the beam from becoming inadvertently dislodged from the column. The self-locking beam clip can be generally angle shaped, having a side flange and a front flange. The side flange can be welded or otherwise rigidly attached to the end of a beam and is disposed adjacent a side face of the column when the beam is engaged thereto. The front flange can have one or more vertically spaced, fixed connecting pins projecting generally perpendicular to the front flange and engaging the face of the column through separate apertures. Each connecting pin conventionally has a shank and a large inner head, wherein the shank is sized to pass through both the upper and lower regions of the apertures and the inner head is sized to pass through only the upper region. To connect the beam clip to the column, the inner heads of the connecting pins are inserted through the upper region and the shank of each connecting pin can be moved down into the narrow lower region and rest on the lower margin of the aperture. Consequently, the larger inner heads of the fixed connecting pins prevent the beam clip from being removed from the face of the column until such time as the beams are lifted to a point where the inner heads can be removed out through the upper region.

The latch member can have a generally flat first portion mounted to the front flange of the beam clip, preferably to one of the fixed connecting pins, and a second portion which can be bent at an angle to the first portion and projects away from the front flange of the beam clip. A hole can be provided through the front flange of the beam clip and an opposite end of the first portion can have a locking portion extending generally perpendicular thereto and projecting through the hole in the front flange. As the fixed connecting pins are inserted through the apertures the first portion flexes outwards, pivoting about the connection to the front flange, and, when the fixed connecting pins are moved down into the lower region, the locking portion automatically snaps into the upper region of an aperture common with the adjacent fixed connecting pin. The latching member thus keeps the beam from becoming unintentionally disengaged from the column by preventing the beam from being moved vertically with respect to the column. As a result, the fixed connecting pins are held in the lower region of the apertures until the locking portion is removed from the aperture so that the beam clip can be moved vertically again. The locking portion can be unlocked by pushing on the second portion of the latch member. This causes the first portion to pivot about the point where it is connected to the front flange, which retracts the locking portion from the aperture in the column, partially out through the hole in the front flange, just enough for the locking portion to clear the aperture so that the beam clip can be moved vertically again to disconnect it from the column.

Other details, objects, and advantages of the invention will become apparent from the following detailed description and the accompanying drawings figures of certain presently preferred embodiments thereof.

BRIEF DESCRIPTION OF THE DRAWING FIGURES

A more complete understanding of the invention can be obtained by considering the following detailed description in conjunction with the accompanying drawings, in which.

Figure 3A:
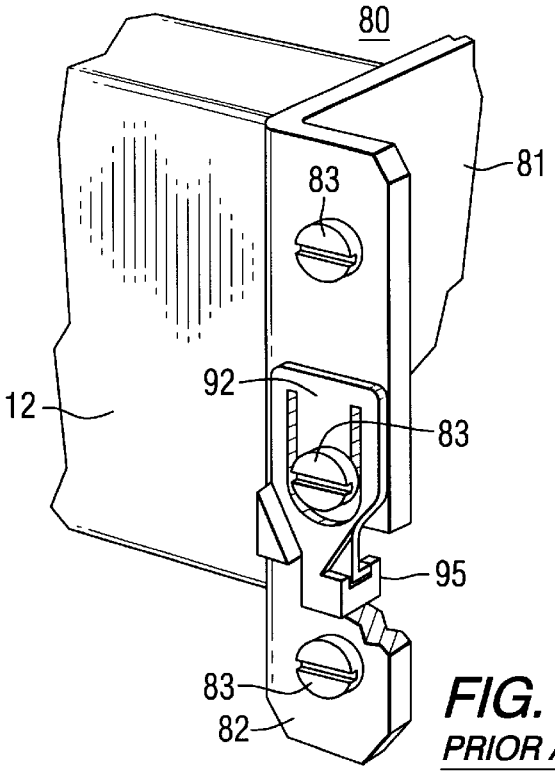
FIG. 3a PRIOR ART
Figure 3B:
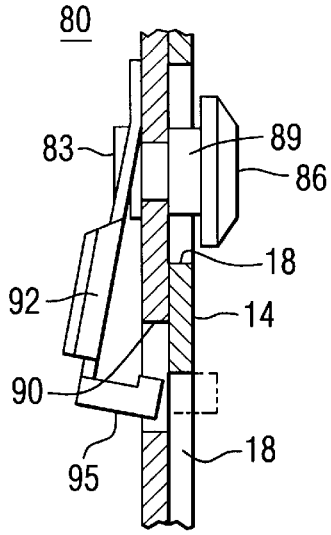
FIG. 3b PRIOR ART
Figure 4:
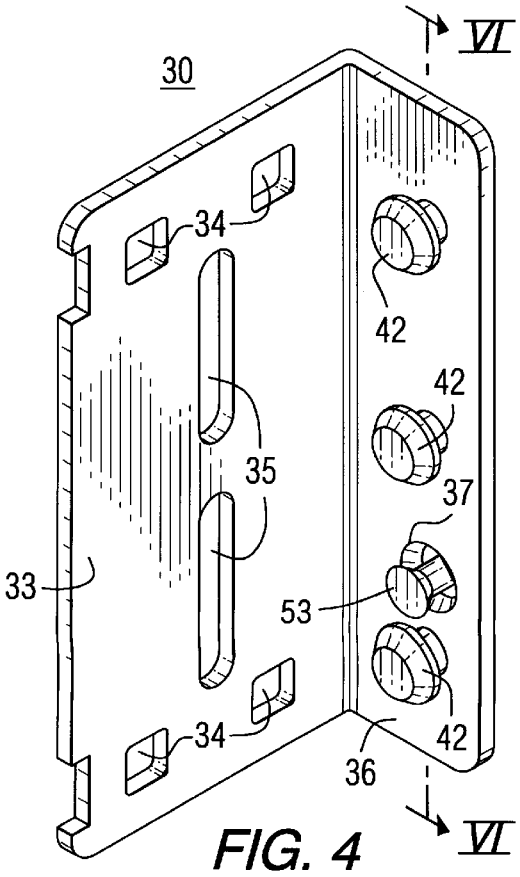
Figure 5:
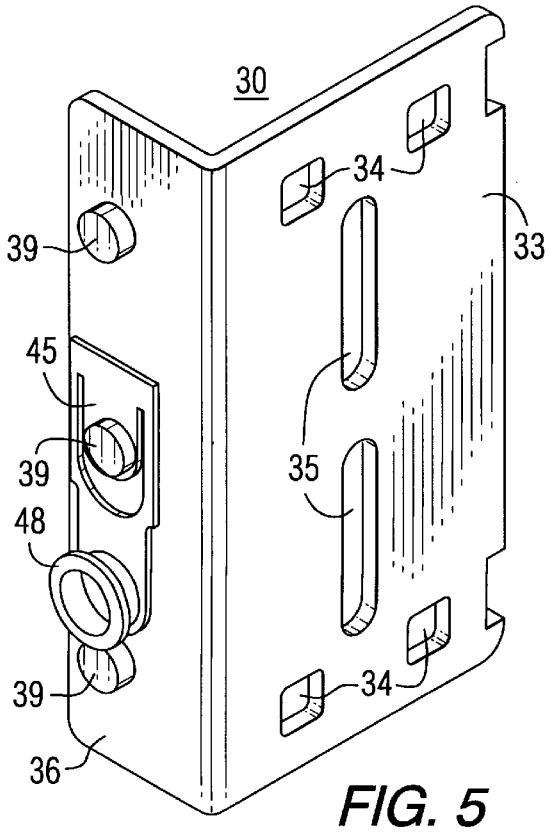
Figure 6A:
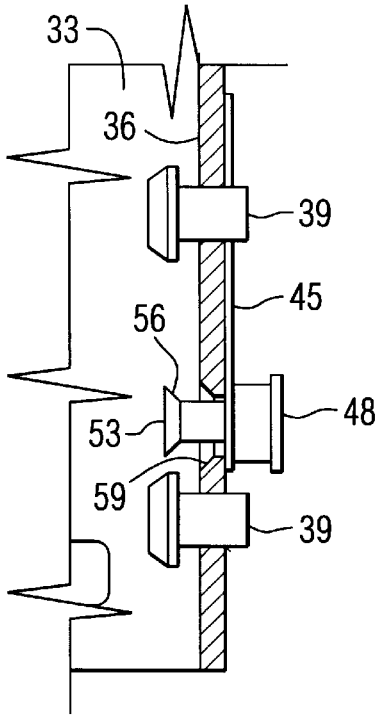
Figure 6B:
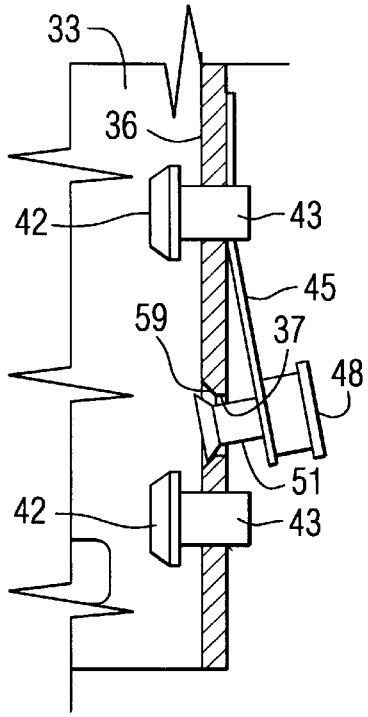
Figure 7A:
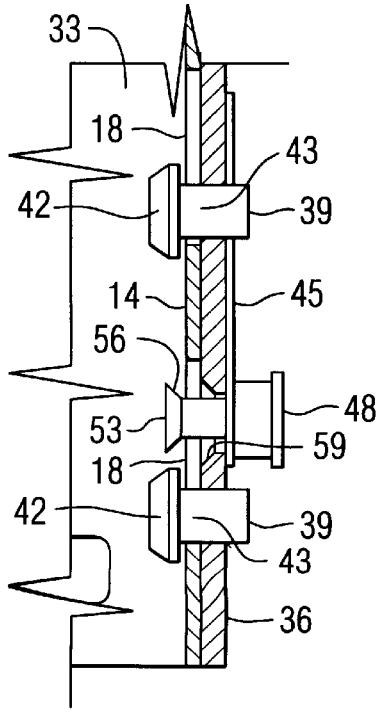
Figure 7B:
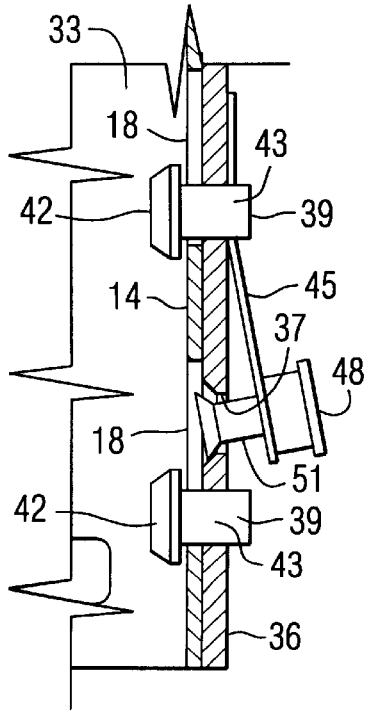

FIG. 3*a* is a perspective view of a prior art type beam clip;

FIG. 3*b* is a end view partially in section of the beam clip shown in FIG. 3;

FIG. 4 is a perspective view of an embodiment of a beam clip according to the present invention;

FIG. 5 is a perspective view of the opposite side of the beam clip shown in FIG. 4;

FIG. 6*a* is a sectional view taken along line VI—VI in FIG. 4 showing the latch in a locked position;

FIG. 6*b* is the beam clip shown in FIG. 4 showing the latch in an unlocked position;

FIG. 7*a* is the beam clip shown in FIG. 6*a* connected to the front face of a column; and FIG. 7*b* is the beam clip shown in FIG. 7*a* with the latch in the unlocked position.

FIG. 8*a* is a perspective view of another embodiment of a beam clip according to the present invention.

Figure 8:
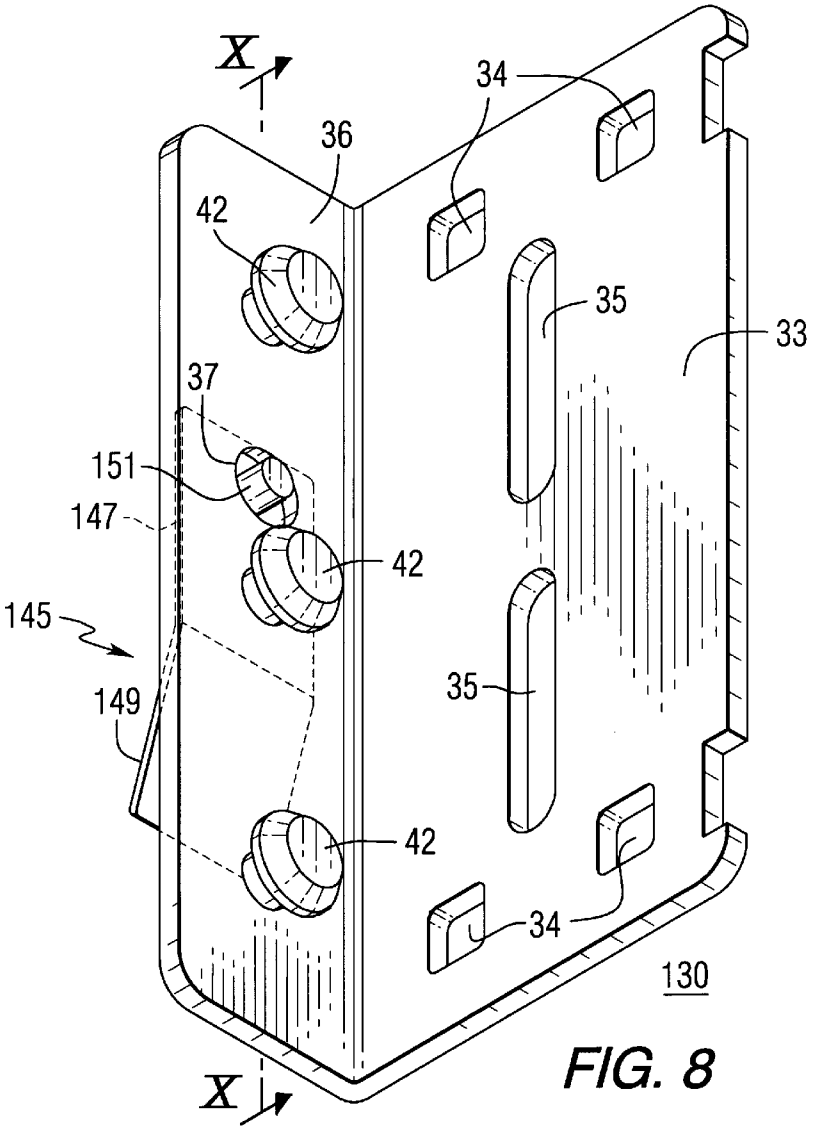
Figure 9:
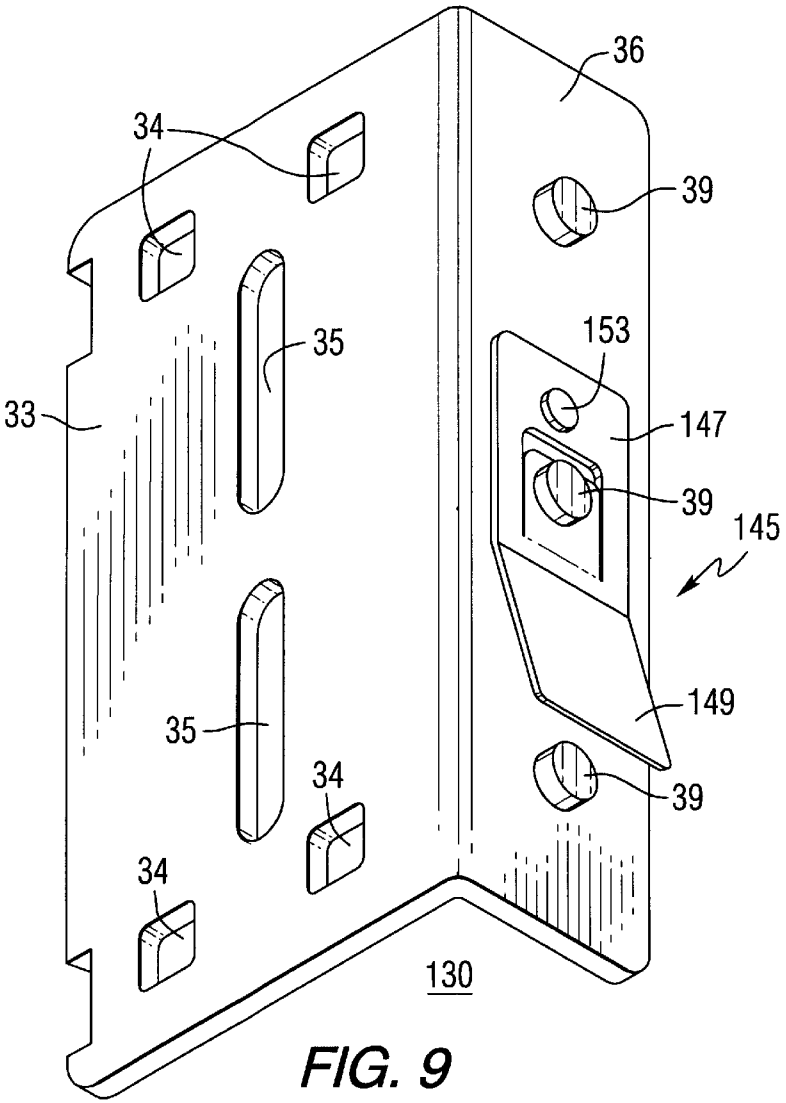

FIG. 9 is a perspective view of the opposite side of the bean clip shown in FIG. 8.

Figure 10A:
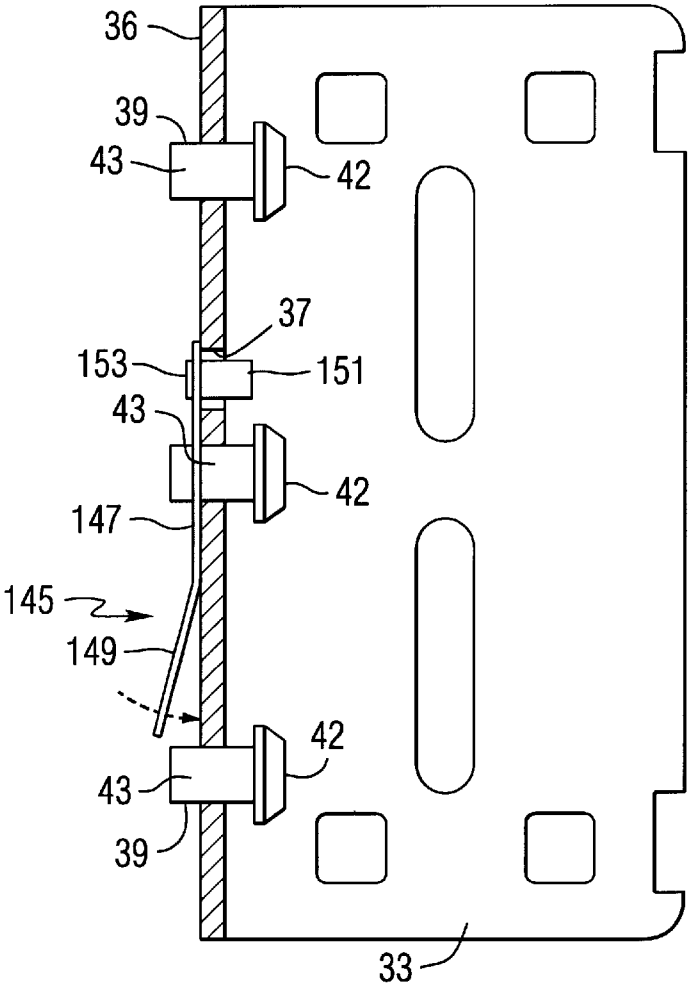
Figure 10B:
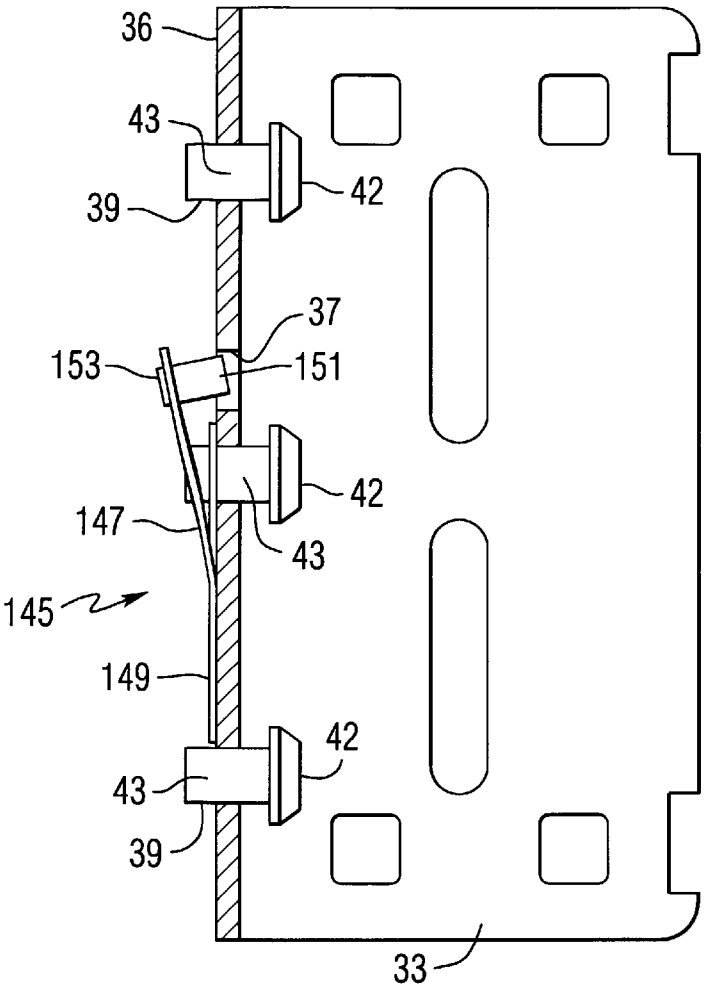

FIG. 10*a* is a sectional view taken along the line X—X in FIG. 8;

FIG. 10*b* is a beam clip shown in the FIG. 10*a* showing the latch in an unlocked position.

Figure 11:
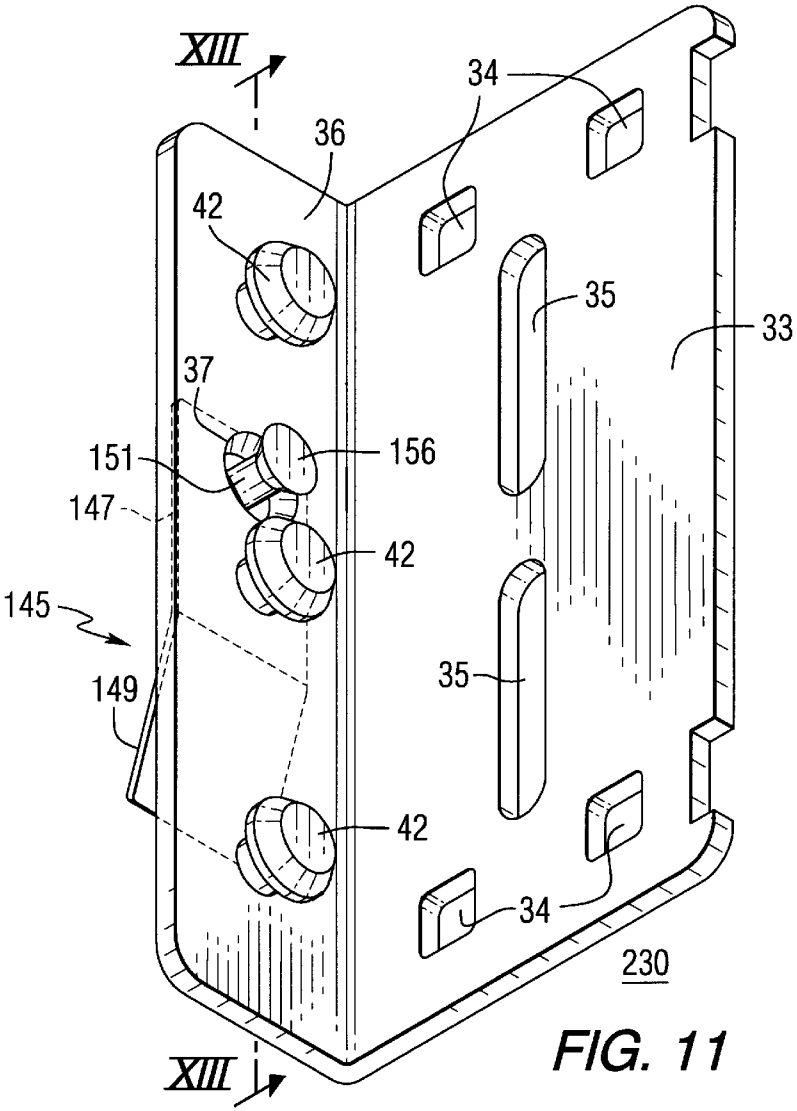

FIG. 11 is a perspective view of another embodiment of a beam clip according to the present invention.

Figure 12:
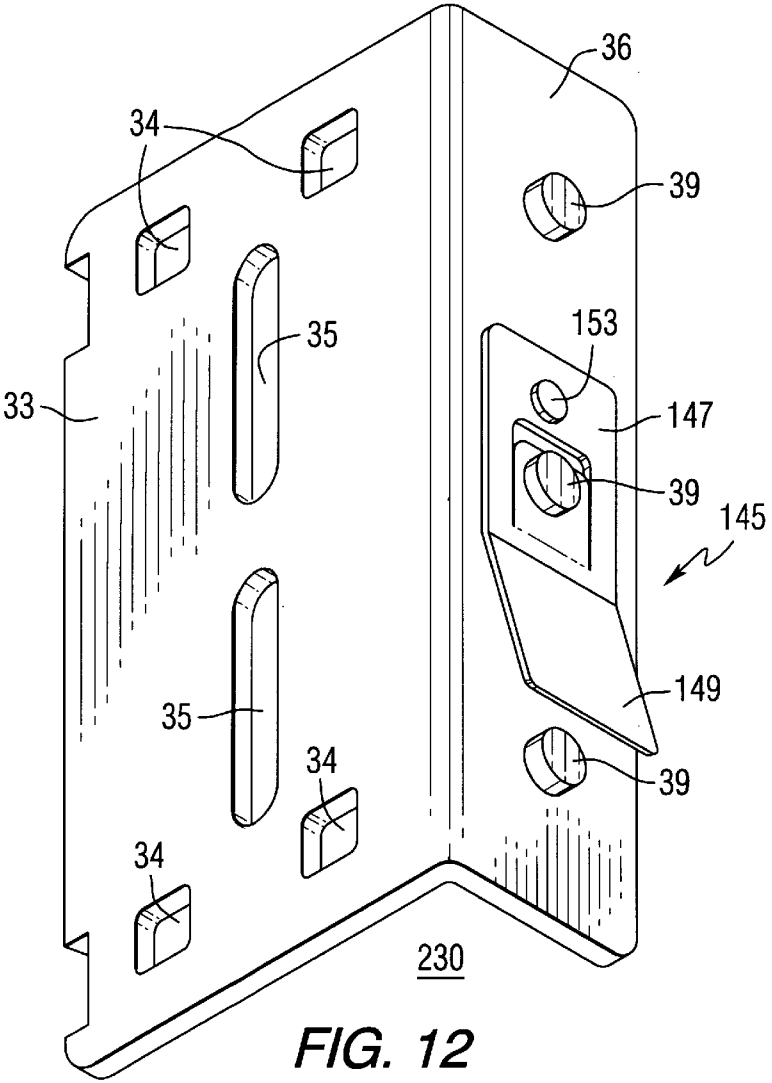

FIG. 12 is a perspective view of the opposite side of the beam clip shown in FIG. 11.

Figure 13A:
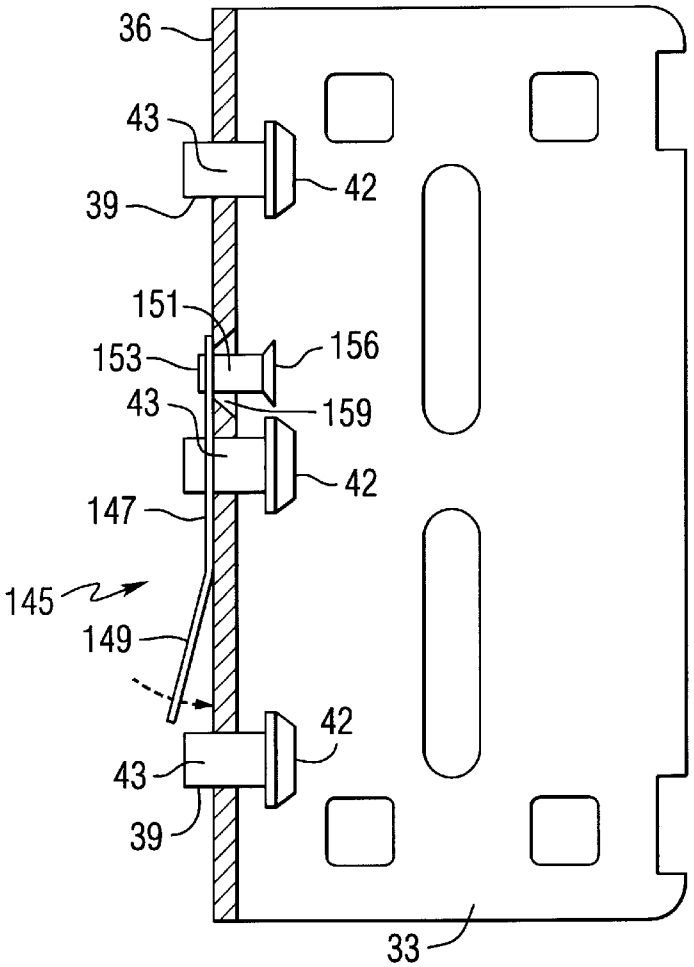

FIG. 13*a* is a sectional view taken along the line XIII—XIII in FIG. 11.

Figure 13B:
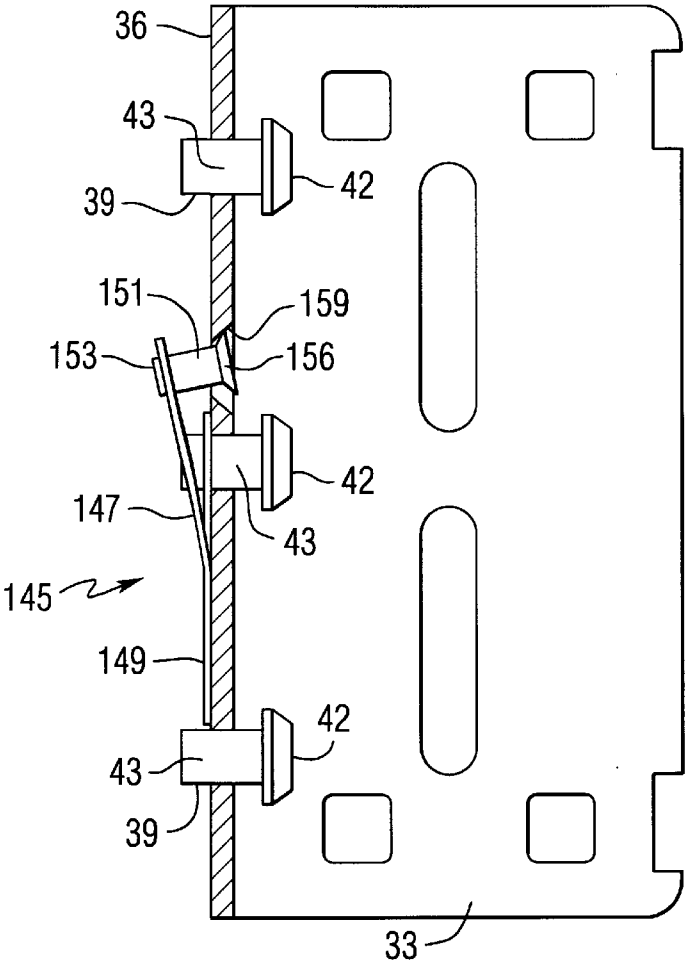

FIG. 13*b* is the beam clip shown in FIG. 13*a* showing the latch in an unlocked position.

Figure 14B:
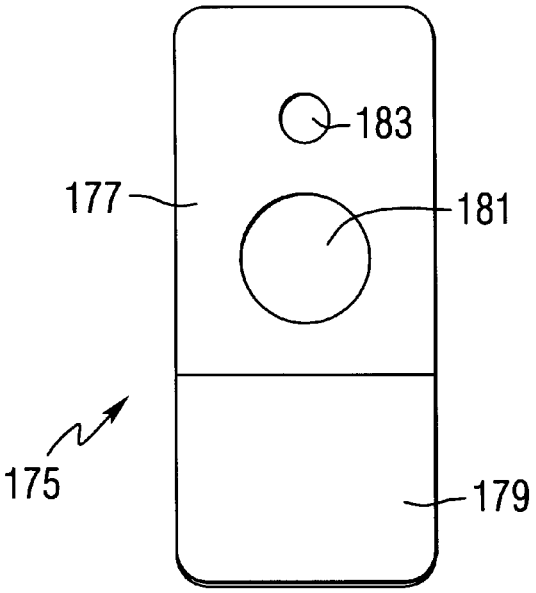
Figure 14A:
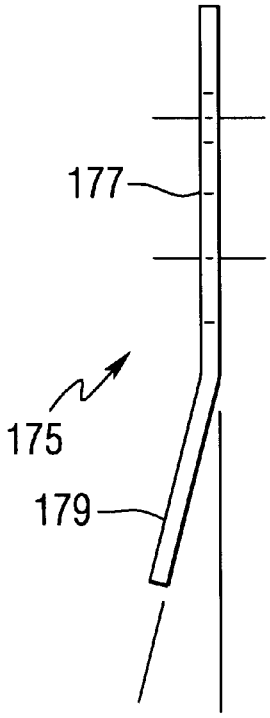

FIG. 14*a* is a side view of an embodiment of the lever arm of the beam clip in FIGS. 8 through 13*b*.

FIG. 14*b* is a front view of a lever arm shown in FIG. 14*a*.

Figure 15:
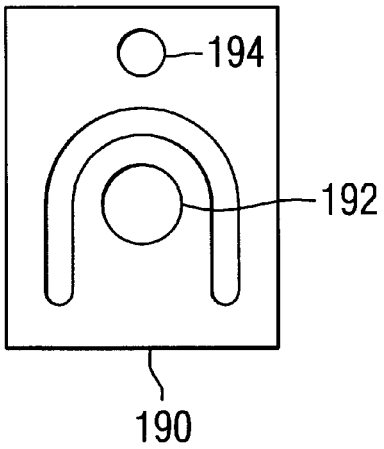

FIG. 15 is a front view of a flexible spring base member which can be used in combination with the lever arm shown in FIGS. 14–14*a*.

DETAILED DESCRIPTION OF CERTAIN EMBODIMENTS

Figure 1:
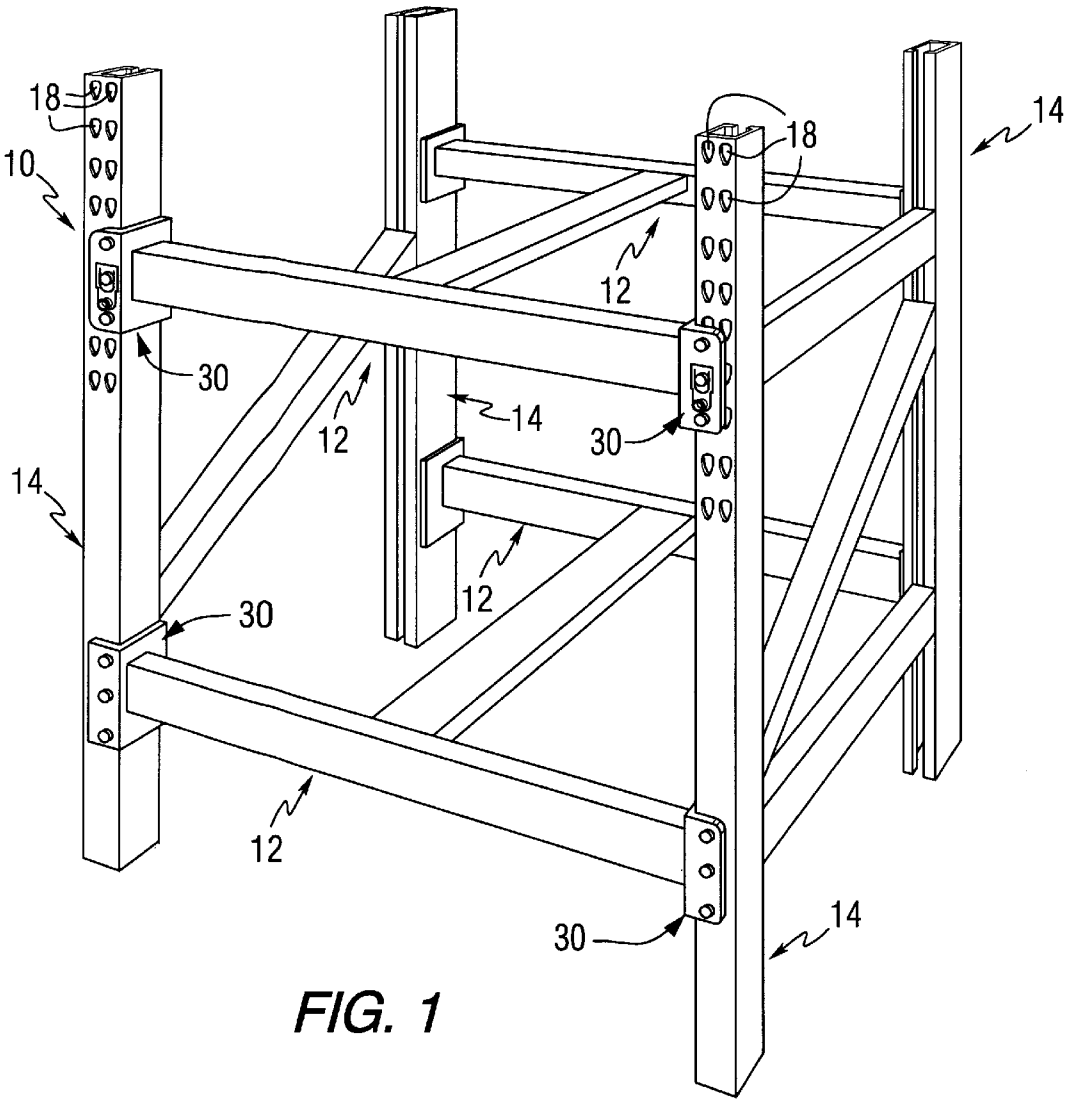
FIG. 1 is a perspective view of a portion of a storage rack system.

Referring now to the drawing figures wherein like reference numbers identify similar elements throughout the several views, a storage rack 10 is shown in FIG. 1 constructed from horizontal beams 12 connected to upright columns 14 by self-locking beam clips 30. The front face of the columns 14 can preferably have a vertical array of apertures 18 for connecting the self-locking beam clips.

Figure 2:
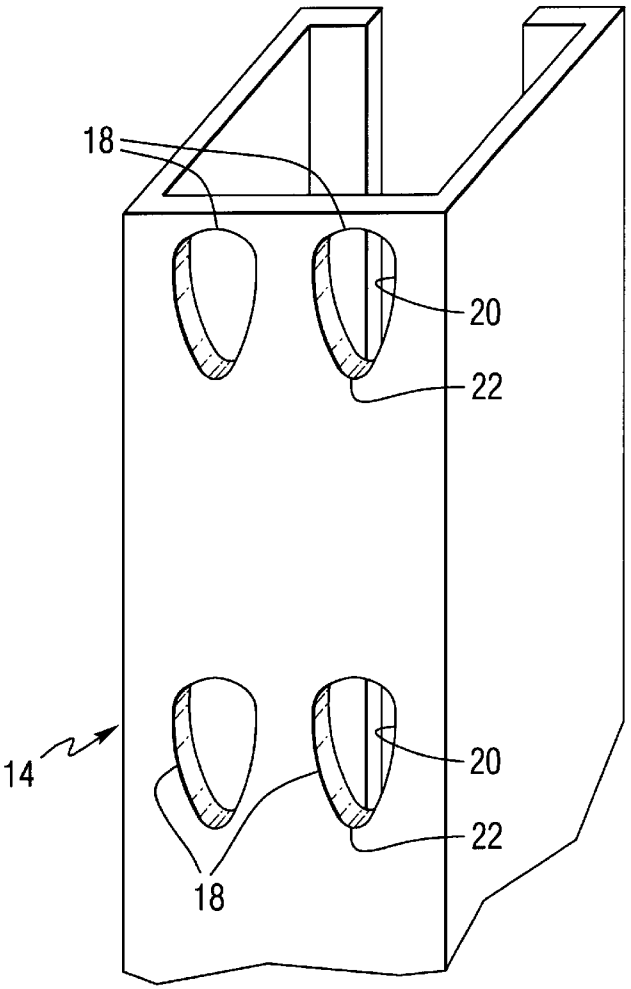
FIG. 2 is a perspective view partially in section of one of the columns of the storage rack shown in FIG. 1 showing the shape of the apertures.

The self-locking beam clips 30 can be attached to the ends of the beams 12 for connecting the ends to the front face of the columns 14 via the array of apertures 18. The beam clips 30 can be welded or otherwise rigidly attached to the ends of the beams 12. The front face of the columns 14 can have a vertical array of spaced, similar apertures, as shown in FIG. 2, which are utilized by the beam clips 30 to hold the beams 12 against the columns. Preferably, the apertures can have a wide upper region 20 and a narrow lower region 22. The apertures 18 can be shaped as shown in FIG. 2, however, different shaped apertures could also be provided.

A prior art angle shaped beam clip 80 is shown in FIGS. 3*a* and 3*b* having a side flange 81 and a front flange 82. The side flange 81 can be welded to the end of the beam 12 and the front flange 82 can have several fixed connecting pins 83 mounted thereon. A spring biased latch pin 92 can be attached to the front flange 82 or the central fixed connecting pin 83, as illustrated. Each fixed connecting pin 83 can have a shank 89 which is sized to pass through both the wide upper and narrow lower regions of an apertures 90, which can be shaped like, for example, the apertures 18 shown in FIG. 2. Each pin 83 can also have an inner head 86 sized to pass through the wide upper region but not the narrow lower region of the aperture 90. The latch pin 92 can have an L-shaped end portion 95 which can project through the aperture 90 which is also occupied by on of the fixed connecting pins 83. The latching pin 92 serves to prevent the beam 12 from becoming disengaged from the column 14 if the beam 12 is inadvertently moved upwards.

A self-locking beam clip according to the invention is shown in FIGS. 4–7*a* having a side flange 33 and a front flange 36. The side flange 33 can be welded to the end of a beam 12 or can be otherwise rigidly attached, for example, by using fasteners through openings 34 and slots 35 in the side flange 33 via holes which can be provided in the side of the beam 12 which abuts the side flange 33. One or more fixed connecting pins 39, and preferably three, can be rigidly mounted on the front flange 36 for connecting the beam 12 to the front wall the column 14 via the apertures 18. Each fixed connecting pin 39 can have an inner head 42 portion and a shank portion 43. The inner head can be sized to pass only through the upper region 20 of the apertures 18 and the shank 43 can be sized to pass through both the upper 20 and lower 22 regions. Accordingly, the inner head 42 can be inserted through the upper region 20 the beam clip 30 can then be translated vertically downward so that the shank 43 of each fixed connecting pin 39 is disposed in the narrow lower region 22 and resting on the lower margin of the aperture 18. In this position, the inner head 42 is retained in the aperture 18 by the narrow lower region 22 such that the beam clip 30 cannot be disengaged from the front wall of the column 14 without first lifting the beam 12 vertically to the former position where the inner heads 42 can be removed out through the wide upper regions of the apertures 18. The leading edge of the inner heads 42 can be beveled to facilitate insertion through the apertures 18. The beveled edges can help the inner heads 42 to self-align when the self-locking beam clip 30 is being connected to the column 14. The connecting pins 39 can be rigidly attached to the front flange 36 by, for example, providing through-holes in the front flange 36. The shank 43 of each fixed connecting pin 39 can be sized to closely fit into the through-holes. Once the shank 43 is fitted into the through-hole the end of the shank 43 can be struck in order to cause it to expand sufficiently to rigidly fix the shank 43 in the through-hole. Alternatively, the shank 43 of each fixed pin 39 can be inserted in the through-holes in the front flange 36 and then welded in place. Moreover, it is to be understood that various other ways of satisfactorily attaching the fixed connecting pins 39 to the front flange could be utilized. Each fixed connecting pin 39 can bear its respective share of the weight carried by the beam 12.

The self-locking beam clip 30 can preferably include a latch 45 which can be centrally disposed between two of the fixed connecting pins 39. Preferably, the latch 45 can be a resiliently flexible member, for example, a flat leaf spring, which can be flexed between locked and unlocked positions. One end of the latch 45 can be mounted on the front flange 36, for example, by attaching it to the central fixed connecting pin 39 as shown in the FIGS. 4–7*b*. The flat leaf spring portion of the latch 45 can have a hole at one end which is sized to closely fit over the shank 43 of a fixed pin 39. The flat leaf spring portion is then fitted onto the shank 43 prior to striking the end of the shank 43. Thus, when the end of the shank 43 is expanded the latch 45 is firmly held against the front flange 36. Also, various other means of attaching the latch 45 to the front flange 36 can be employed. Further, the latch 45 could be removably attached if desired. Another end of the latch 45 can have a locking portion 53 which can extend generally perpendicular to the latch 45 and through a hole 37 provided through the front flange 36. Preferably, the locking portion 53 is normally biased in a locked position and the latch 45 must be flexed in order to move the locking portion 53 to an unlocked position. A knob 48 can be provided on the latch opposite the locking portion 53 for conveniently grasping the latch 45 to flex it to the unlocked position. The spring member of which the latch 45 is formed can bias the locking portion 53 back to the locked position when the knob 48 is released. The locked and unlocked positions of the latch 45 are shown best in FIGS. 6*a*–7*b*. In FIGS. 6*a* and 7*a* the latch 45 is shown in the normal locked position. To unlock the latch 45 the knob 48 can be grasped and pulled to flex the latch 45 to the unlocked position shown in FIGS. 6*b* and 7*b*. The locking portion 53 can include a shank portion 51 and an oversize end 56. The oversize end 56 can preferably be larger than the hole 37 in the front flange such that the locking portion 53 cannot be removed completely through the hole 37. The oversize end 56 serves as a retainer to help prevent the flat leaf spring member, i.e. the latch 45, from being overly flexed. If overly flexed, the latch 45 could be deformed such that the locking portion 53 would not be biased in a locked position. Preferably, the hole 37 in the front flange 36 can have a tapered edge, similar to a countersink, and the oversize end 56 can have a reverse tapered edge. Consequently, when the latch 45 is flexed to the unlocked position the oversize end 56 can seat generally flush with the inner surface of the front flange 36. As a result, less clearance, for the thickness of the front wall of the column 14, is required between the inner heads 42 of the fixed connecting pins 39 and the inner surface of the front flange 36.

The self-locking beam clip 30 is shown in FIGS. 7*a*–7*b* attached to the front wall of a column 14 with the fixed connecting pins 39 and the locking portion 53 projecting through the apertures 18. To install the self-locking beam clip 30, the inner heads 42 of the fixed connecting pins 39 are first lined up with and inserted through the upper regions 20 of the apertures 18. When the fixed connecting pins 39 are inserted through the apertures 18, the locking portion 53 is not aligned with any aperture 18 and thus is pushed outwards, causing the latch 45 to flex. The fixed connecting pins 39 are then moved downwards, by sliding the end of the beam 12 downwards, such that the shank 43 of each fixed connecting pin 39 is disposed in the lower region 22 and resting on the lower margin of the aperture 18. When the fixed connecting pins 39 are moved downwards the locking portion 53, which is biased against the column 14 by the leaf spring member, snaps into the upper region 20 of the aperture 18, which is also occupied by an adjacent fixed connecting pin 39. The spacing between the locking portion 53 and the fixed connecting pin 39 is tailored according to the length of the aperture 18 such that the shank 51 of the locking portion 53 is disposed near the upper margin of the aperture 18 and the shank 43 of the fixed connecting pin 39 is resting on the lower margin of the aperture 18. Consequently, the locking portion 53 abuts against upper margin of the aperture 18 which prevents the beam 12 from being moved upwards. The inner heads 42 of the fixed connecting pins 39 are thus retained in the lower regions 22 of the apertures 18 from which they cannot be removed. Consequently, not withstanding applying enough force to destroy the beam clip, the beam 12 cannot be disconnected from the column 14 so long as the latch 45 is in the locked position. The latch 45 can thus prevent inadvertent disengagement of the beams 12 from the columns 14 which might otherwise result in damage to items stored on the storage racks and possible injury to bystanders.

To remove the self-locking beam clip 30 from the column 14 the latch 45 must first be flexed, by pulling on the knob 48, to the unlocked position, shown in FIGS. 6*b* and 7*b*. With the locking portion 53 retracted from the aperture 18 and no longer restricting vertical movement, the self-locking beam clip 30 can now be moved upwards so that the inner heads 42 of the fixed connecting pins 39 can be removed through the upper regions 20 of the apertures 18.

Another embodiment of a beam clip 130 according to the present invention is illustrated in FIGS. 8 and 9, having a differently configured latch member 145, wherein a locking portion 153 thereof is movable between locked and unlocked positions. The latch 145 has a first portion 147 pinned, via the central fixed connecting pin 39, to the front flange 36, and an angled second portion 149 which projects at an angle to the first portion 147 and away from the front flange 36 of the beam clip 130. The locking portion 153 is connected to a distal end of the first portion 147 and projects through the hole 37 in the front flange 36. The locking portion 153 can be moved between the locked and unlocked positions by pushing on the second portion 149 of the latch 145 which causes the latch 145 to pivot on the front flange 36 about the fixed connecting pin 39. The first portion 147 of the latch member 145 can be resiliently flexible, such as a flat leaf spring, and configured to flex about the connection to the front flange 36.

FIGS. 10*a* and 10*b* illustrate the movement of the locking portion 153 from the locked position shown in FIG. 10*a* to the unlocked position shown in FIG. 10*b*. As indicated by the dotted arrow, as the second portion 149 is pushed towards the front flange 36, the latch member 145 pivots about the fixed connecting pin 39 which results in the locking portion 153 being pivoted partially out from the hole 37 in the front flange, at least for enough for the clip 130 to be detached from the column 14.

Referring now to FIGS. 11 through 13*b*, another embodiment of a beam clip 230 is shown. The beam clip 230 can be identical to the beam clip 130 except that the locking portion 153 can be provided with an oversized end portion 156 which prevents the locking portion 153 from being removed completely through the hole 37 in the front flange 36. Similarly to the oversized end 56 of the locking portion 45 on the beam clip 30 shown in FIGS. 4–7*b*, the oversized end 156 serves as a retainer to prevent the first portion 147 of the latch member 145 from being completely removed through the hole in the front flange 36 of the beam clip 230. Consequently, the first portion 147 of the latch member 145 cannot be over flexed if unlocked in an inappropriate manner. Preferably, the hole 37 in the front flange 36 can have a tapered edge, similar to a counter sink, and the oversized end 156 can have a tapered edge which mates with the tapered edge in the hole 37. Therefore, like the embodiment of the beam clip 30 in FIG. 4, when the latch member 145 is pivoted to the unlocked position, the oversized end 156 will seat generally flush with the inner surface of the front flange 36.

An alternative embodiment of a latch member 175 is shown in FIGS. 14*a* and 14*b* having a generally flat first end 177 and an second end 179 similar to the latch member 145. As shown in FIG. 14*b*, the first end 177 is provided with a central opening 181 which can be utilized for rigidly connecting the latch member 175 to the front flange 36 via one of the fixed connecting pins 39. The first end 177 of the latch member 175 can also have a second opening 183 through which the shank 151 of the locking portion 153 is rigidly fixed, as shown in FIGS. 13A–13B. These latter two features are also similar to the latch member 145. However, as an alternative to forming the first end 177 of the latch member 175 as a flexible leaf spring, a thin flexible spring member 190 can be provided, as shown in FIG. 15, which can be connected between the latch member 175 and the front flange 36. The flexible spring member 190, like the latch member 175 shown in FIG. 14*b*, can have a central hole 192 provided therein for connecting to the shank 43 of the fixed connecting pin 39, and a second opening 194 provided therein through which the shank 151 of the locking portion 153 is connected. Using the spring member 190 to provide the resilient flexing action to permit the latch member 175 to pivot about the front flange 36 allows the latch member 175 itself to be more easily produced.

Thus, according to the latter two embodiments of the beam clip 130, 230 shown in FIGS. 8 through 13*b*, a simpler and easier to use latch member 145, 175 can be provided to enable the locking portion to be moved to the unlocked position more quickly and easily than heretofore possible. The simple pushing action enabled by the angled latching member 145, 175 can be very advantageous in the environment in which these types of beam clips are most often employed. Such environment typically being a warehouse type environment where workers are apt to wear gloves. Consequently, it can be difficult, while wearing gloves, to grasp and pull on relatively small objects, such as the knob 48 provided in the embodiment of the beam clip shown in FIGS. 4 through 7*b*. This is even more true where no knob to grasp is provided at all. In situations where the worker is wearing gloves, the beam clip 130, 230 shown in FIGS. 8 through 13*a* provides a more convenient and positive means for unlocking the beam clip so that the beam can be removed from the columns. Preferably, the length and angle of the lower portion 149, 179 of the latch member 145, 175 is designed such that the full range of movement to which the latching member 145, 175 can be pivoted does not result in any permanent deformation of the lower portion 147 or the spring member 190 when the locking portion 153 is moved to the unlocked position. However, an embodiment of the beam clip 230, like the beam clip 30, can employ an oversized end 156 on the locking portion 153 to entirely eliminate the possibility of over flexing the resiliently flexible member 147, 190 in the event that the latching member 145 were opened in an unconventional manner.

Although certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A self-locking beam clip for connecting one end of a horizontal beam to a vertical column wherein the column has a front wall with a vertical array of spaced apertures, the self-locking beam clip comprising:

a. a flanged member having a front flange connectable to said front wall of said column and a side flange attachable to said one end of said beam, said front flange having a hole therethrough;

b. at least one connecting pin rigidly mounted to said front flange for projecting through a selected one of said array of spaced apertures, said at least one connecting pin having an inner head and a shank interposed between said inner head and said front flange, said shank being smaller in diameter than said inner head and said inner head being spaced from said front flange by a fixed distance;

c. a latch member having a first portion pivotably connected to said front flange and a second portion extending away from said front flange at an angle to said first portion;

d. a locking portion connected to a distal end of said first portion, said locking portion projecting through said hole in said front flange; and e. said latch member movable between a locked position and an unlocked position, said locking portion arranged to project through a common one of said apertures with one of said at least one connecting pins only in said locked position, wherein said one connecting pin extends through said first portion and occupies a lower region of said common aperture and said locking portion occupies an upper region of said common aperture such that said locking portion restrains movement of said beam relative to said column, said latch member movable to said unlocked position by pushing said second portion toward said front flange.

2. The self-locking beam clip of claim 1 further comprising a retainer preventing said locking portion from being completely removed through said hole in said front flange.

3. The self-locking beam clip of claim 2 wherein said retainer comprises said locking portion having an oversized end larger than said hole in said front flange such that said oversized end prevents said locking portion from being completely removed through said hole when said second portion is pushed to move said locking portion to said unlocked position.

4. The self-locking beam clip of claim 3 further comprising said hole in said flange having a tapered edge and said oversized end having a reverse tapered edge for mating with said tapered edge of said hole such that when said second portion is pushed to move said locking portion to said unlocked position said oversized end fits generally flush in said reverse tapered edge of said hole and yet is restrained from being removed completely therethrough.

5. The self-locking beam clip of claim 1 wherein said first portion is a resiliently flexible spring member.

6. The self-locking beam clip of claim 1 further comprising:

a. a generally flat resiliently flexible spring member connected between said front flange and said first portion of latch member such that pushing on said second portion causes said first portion and said spring member to pivot about said front flange to move and locking portion to said unlocked position.

7. The self-locking beam clip of claim 1 wherein said at least one connecting pin is a plurality of connecting pins and said latch member is mounted between a pair of said plurality of connecting pins.

8. A beam having an end connectable in a self-locking manner to a column wherein the column has a front wall with a vertical array of spaced apertures, said end of said beam comprising:

a. a front flange member connectable to said front wall of said column and a side flange attachable to said one end of said beam, said front flange having a hole therethrough;

b. at least one connecting pin rigidly mounted to said front flange for projecting through a selected one of said array of spaced apertures, said at least one connecting pin having an inner head and a shank interposed between said inner head and said front flange, said shank being smaller in diameter than said inner head and said inner head being spaced from said front flange by a fixed distance;

c. a latch member having a first portion pivotably connected to said front flange and a second portion extending away from said front flange at an angle to said first portion;

d. a locking portion connected to a distal end of said first portion, said locking portion projecting through said hole in said front flange; and e. said latch member movable between a locked position and an unlocked position, said locking portion arranged to project through a common one of said apertures with one of said at least one connecting pins only in said locked position, wherein said one connecting pin extends through said first portion and occupies a lower region of said common aperture and said locking portion occupies an upper region of said common aperture such that said locking portion restrains movement of said beam relative to said column, said latch member movable to said unlocked position by pushing said second portion toward said front flange.

9. The beam claim 8 further comprising a retainer preventing said locking portion from being completely removed through said hole in said front flange.

10. The beam of claim 9 wherein said retainer comprises said locking portion having an oversized end larger than said hole in said front flange such that said oversized end prevents said locking portion from being completely removed through said hole when said second portion is pushed to move said locking portion to said unlocked position.

11. The beam of claim 10 further comprising said hole in said flange having a tapered edge and said oversized end having a reverse tapered edge for mating with said tapered edge of said hole such that when said second portion is pushed to move said locking portion to said unlocked position said oversized end fits generally flush in said reverse tapered edge of said hole and yet is restrained from being removed completely therethrough.

12. The beam of claim 8 wherein said first portion is a resiliently flexible spring member.

13. The beam of claim 8 further comprising:

a. a generally flat resiliently flexible spring member connected between said front flange and said first portion of latch member such that pushing on said second portion causes said first portion and said spring member to pivot about said front flange to move said locking portion to said unlocked position.

14. The beam of claim 8 wherein said at least one connecting pin is a plurality of connecting pins and said latch member is mounted between a pair of said plurality of connecting pins.

* * * * *